US005704792A

United States Patent [19]

Sobhani

[11] Patent Number: 5,704,792

[45] Date of Patent: Jan. 6, 1998

[54] SPRING LOADED ROTARY CONNECTOR

[75] Inventor: Mohi Sobhani, Encino, Calif.

[73] Assignee: Hughes Aircraft Company, Los Angeles, Calif.

[21] Appl. No.: 680,075

[22] Filed: Jul. 15, 1996

Related U.S. Application Data

[63] Continuation of Ser. No. 445,519, May 22, 1995, abandoned.

[51] Int. Cl.[6] ..... H01R 39/10; H01R 23/66

[52] U.S. Cl. ..... 439/21; 439/67

[58] Field of Search ..... 439/20–22, 27, 439/29, 30, 67, 77, 492

[56] References Cited

U.S. PATENT DOCUMENTS

| | | | |
|---|---|---|---|
| 3,314,038 | 4/1967 | Rutten | 439/21 |
| 3,439,307 | 4/1969 | Ruscher | 439/29 |
| 3,594,680 | 7/1971 | Buschbom | 439/29 |
| 4,447,109 | 5/1984 | Hobart, Jr. | 439/874 |
| 4,623,584 | 11/1986 | Masui et al. | 428/304.4 |
| 4,699,592 | 10/1987 | Gallo et al. | 439/27 |
| 4,773,866 | 9/1988 | Basques | 439/21 |
| 4,932,882 | 6/1990 | Kang | 439/22 |
| 5,049,083 | 9/1991 | Lin | 439/26 |
| 5,484,294 | 1/1996 | Sobhani | 439/21 |

FOREIGN PATENT DOCUMENTS

| | | | |
|---|---|---|---|
| 1320114 | 1/1963 | France | 439/21 |
| 458129 | 2/1951 | Italy | 439/21 |

*Primary Examiner*—Gary F. Paumen

*Attorney, Agent, or Firm*—M. E. Lachman; M. W. Sales; W. K. Denson-Low

[57] ABSTRACT

A rotary connector comprising first and second printed wiring boards that rotate relative to each other and that are electrically interconnected using spring loaded pogo-stick type contacts. The spring-loaded contacts are used to transfer electrical signals or power to metallized rings or contacts formed on the first printed wiring board. The spring-loaded pogo-stick type contacts are very rugged and provide for a rotary connector having long life.

7 Claims, 2 Drawing Sheets

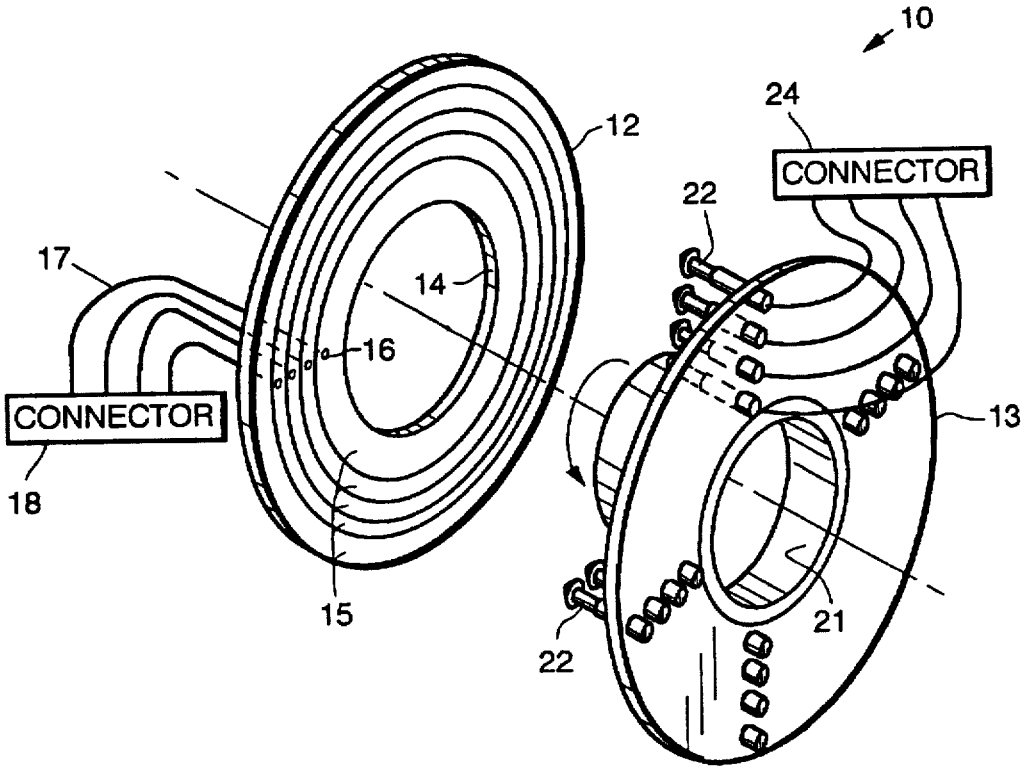
FIG. 1.
FIG. 2.
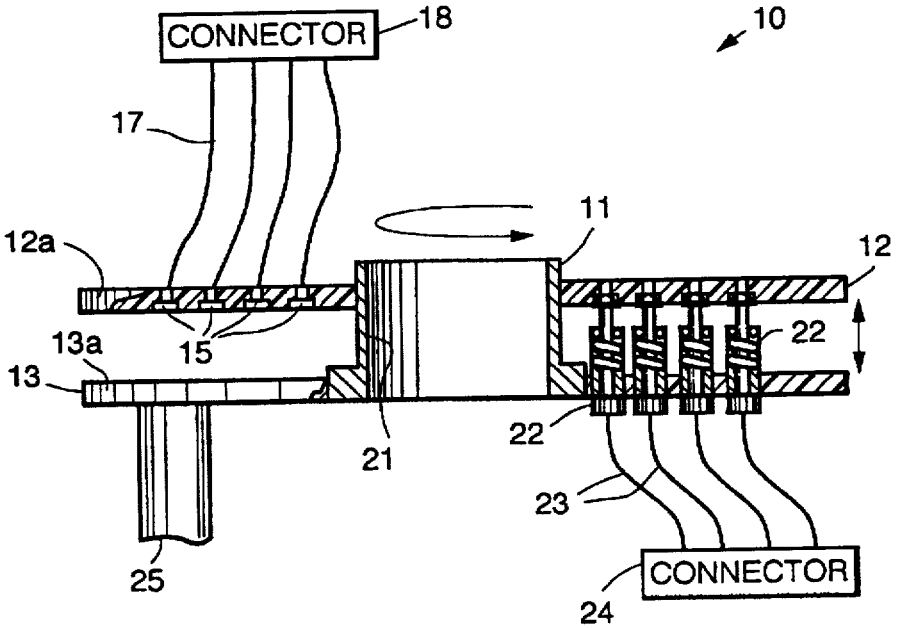

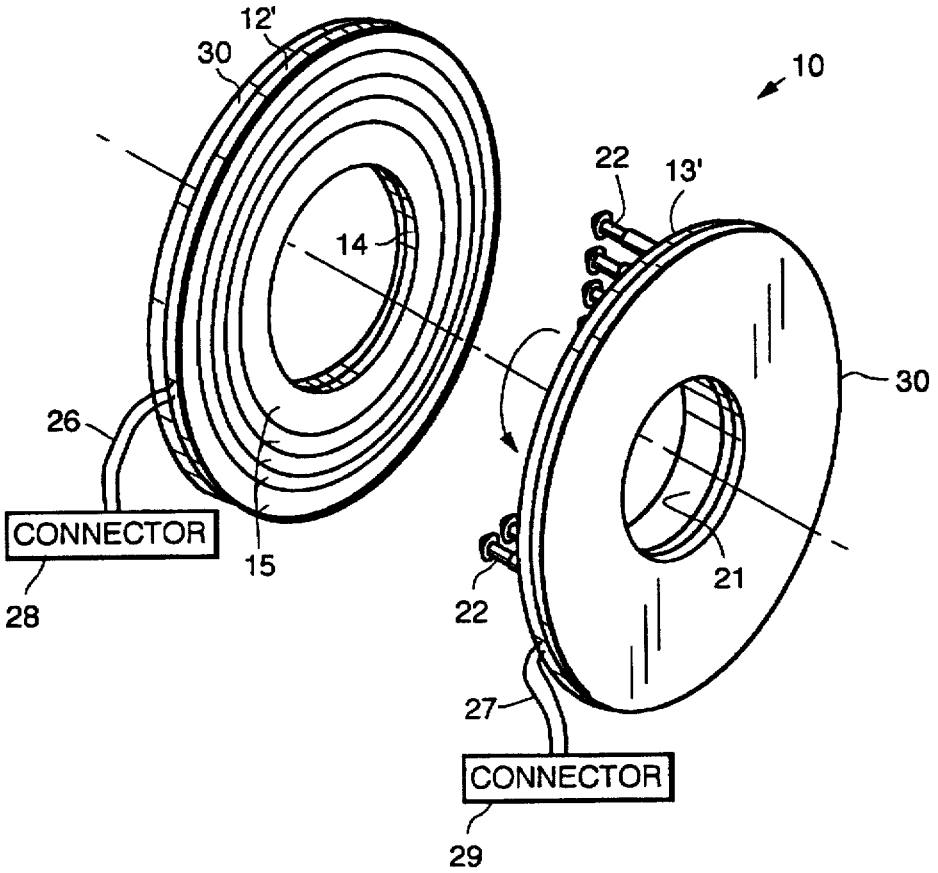
FIG. 3.
FIG. 4.
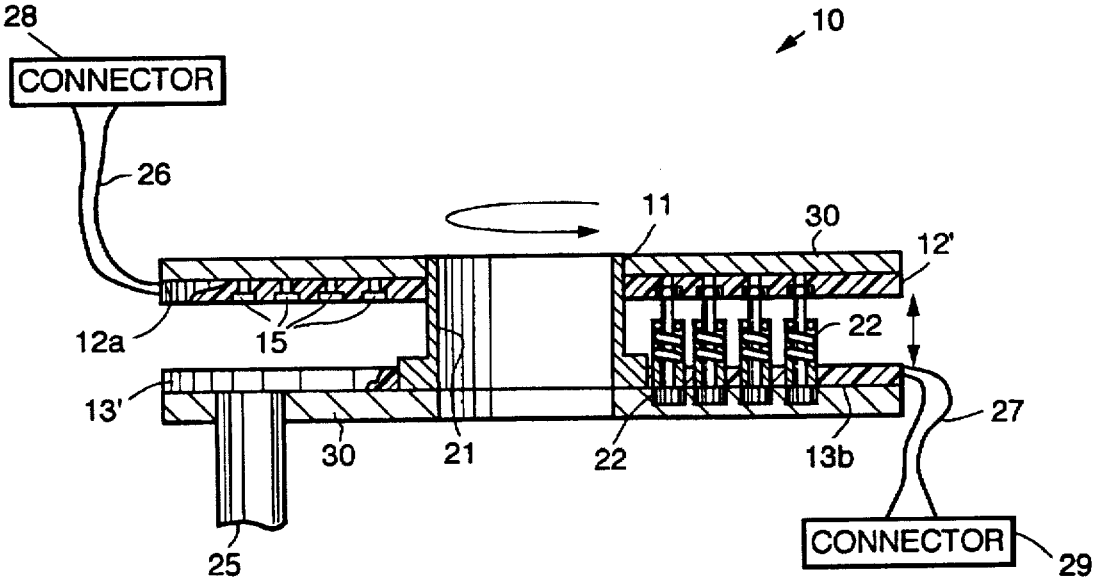

SPRING LOADED ROTARY CONNECTOR

This is a continuation of application Ser. No. 08/445,519 filed May 22, 1995, now abandoned.

BACKGROUND OF THE INVENTION

The present invention generally relates to rotary connectors, and more particularly, to an improved spring loaded connector comprising rotatable printed wiring boards electrically interconnected by spring loaded contacts.

The purpose of a rotary connector is to transmit power or signals from a stationary object to a moving or rotating object. A conventional slip ring connector is a very fragile device. Conventional slip rings are impractical and very vulnerable to road hazards for use in automobile and transportation vehicles. In harsh environments, such as those encountered in aircraft and vehicular use, such slip ring connectors often fail due to the fragile nature of brushes and rings used therein.

Therefore, it is an objective of the present invention to provide for an improved rotary connector comprising rotatable printed wiring boards electrically interconnected by spring loaded contacts.

SUMMARY OF THE INVENTION

In order to meet the above and other objectives, the present invention provides for a spring loaded connector the uses printed wiring boards that rotate relative to each other that are electrically interconnected using a plurality of sets of spring loaded pogo-stick type contacts. In the present invention, the spring-loaded rotary connector pogo-stick type contacts are used to transfer electrical signals or power between two sets of metallized contacts formed on printed wiring boards, for example. The spring-loaded rotary connector pogo-stick type contacts are very rugged and provide for a rotary connector having long life.

The present rotary connector can withstand harsh outdoor environments such as when it is used in axles of automobiles and trucks, for example. The present rotary connector is designed and fabricated using spring-loaded pogo stick-type contacts and insulative material. The pogo-stick type contacts of the rotary connector are sandwiched between two printed wiring boards and can withstand harsh road or highway environment.

The present rotary connector may be used to transmit power or signals from a stationary object to a moving object. The present rotary connector can replace existing slip-ring type connectors currently used in many aircraft and vehicle applications. The spring loaded rotary connector is very rugged and performs well in harsh outdoor environments. Two connectors have been built and tested on an auto axle and have met all expectations. The present invention may be used in cars, trucks, motor homes, motorcycles, and aircraft, wherever rotary electrical connectors may be employed.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates an exploded perspective view of a spring loaded rotary connector in accordance with a first embodiment of the present invention; and FIG. 2 illustrates a cross sectional side view of the spring loaded rotary connector of FIG. 1.

FIG. 3 illustrates an exploded perspective view of a spring loaded rotary connector in accordance with an alternative embodiment of the present invention.

FIG. 4 illustrates a cross sectional side view of the spring loaded rotary connector of FIG. 3.

DESCRIPTION OF THE PREFERRED EMBODIMENTS

Referring to the drawing figures, FIG. 1 illustrates an exploded perspective view of a spring-loaded rotary connector 10 in accordance with the principles of the present invention. FIG. 2 illustrates a cross sectional side view of the spring-loaded rotary connector 10 of FIG. 1. The spring-loaded rotary connector 10 is illustrated with reference to its use in a shaft-type application, wherein its rotatable components are designed to mate with a shaft 11 that rotates relative to a fixed housing 25 or member 25 or relative to the second member 13. However, it is to be understood that the present connector 10 may be readily used in other applications.

The exemplary rotary connector 10 is comprised of first and second members 12, 13 that are mutually rotatable relative to each other. As shown in FIG. 1, the first member 12 may be comprised of a copper laminated phenolic ring **12*a* having an opening 14 therein for receiving the shaft 11, that is machined (grooved) to form a plurality of electrically isolated metallic rings 15. Each of the rings 15 are drilled or otherwise formed so that each ring 15 has a hole 16 therethrough. The holes 16 are plated through to permit soldering of insulated electrical wires 17 thereto. The holes 16 have insulated wire soldered therein on one side thereof (distal from the second member 13) and the wires 17 are routed to a connector 18** that provides for connection to an external electrical signal source or power source (not shown), for example.

The second member 13 may comprise a phenolic plate **13*a* or ring 13*a* which may have an opening 21 therein for receiving the shaft 11, and that is machined to accept a plurality of sets of spring-loaded individual pogo-stick type contacts 22 generally mounted at equally spaced locations so that they are positioned to engage the plurality of electrically isolated metallic rings 15 of the copper laminated phenolic ring 13*a* or first member 13. Insulated wires 23 are soldered between respective bottoms of the pogo-stick type contacts 22 and a connector 24** that may be connected to one or more sensors (not shown), for example.

The pogo-stick type contacts 22 are commercially available, for example, from Test-X Fixture Products (Riverside, Calif.), part number TX416S2 or TX416S3.

In accordance with an alternative embodiment of the present invention, the first and second members comprise flexible printed circuits, alternatively referred to as "flexprints". This embodiment of the present invention is illustrated in FIGS. 3 and 4, wherein the same reference designators have been used as in FIGS. 1 and 2 to designate like structural elements. In FIGS. 3 and 4, first member 12' comprises a flexprint having a plurality of metallic rings 15 formed thereon; and second member 13' comprises a flexprint having a plurality of spring-loaded contacts 22 disposed therein. The spring-loaded contacts 22 are attached by soldering, welding, or other attachment means, such as on the external surface **13*b* of the second member 13'. The portion 26 of first flexprint member 12' contains a first plurality of electrical wires that are attached to the plurality of metallic rings 15 at one end and to a first connector 28 at the opposite end. The portion 27** of the second flexprint member 13' contains a second plurality of electrical wires that are attached to the spring-loaded contacts 22 at one end and to a second connector 29 at the opposite end. While FIGS. 3 and 4 show both members 12' and 13' as being flexprints, it is within the scope of the present invention to have one of the members be a flexprint and the other member a printed wiring board.

As a further improvement, a rigid plate 30, such as of aluminum, may be provided on either side of the assembled structure shown in FIG. 4 to maintain flatness.

The spring-loaded rotary connector 10 permits relative angular movement between the shaft 11 and the housing 25 that secures the second member 13. The spring-loaded rotary connector 10 also compensates for movement between the first and second members 12, 13 in terms of their separation distance. More specifically, if the respective planes of the first and second members 12, 13 are not parallel, then the pogo-stick type contacts 22 adjust for the differences in distance therebetween. This may be caused by vibration of a vehicle, for example, or relative movement between the components that are connected to the shaft 11 and the housing 25 to which the second member 13 is secured. This might be the relative movement between an axle and a wheel of a vehicle, for example. The relative motion is compensated for by the spring-loaded individual pogo-stick type contacts 22 which operate to keep electrical contact with the respective metallic rings 15 irrespective of the relative angular relationship between the first and second members 12, 13.

The rotary connector 10 is shown as comprising flat members 12, 13 that are designed to engage the shaft 11. However, it is to be understood that contoured members 12, 13 such as may be provided by cylindrical or spherical members, for example, may be employed as well as flat members 12, 13. Therefore, the present connector 10 is not limited to a configuration that is flat.

The rotary connector 10 has been designed to withstand harsh outdoor environments such as when it is used in axles of automobiles and trucks, for example. The rotary connector 10 may be used to transmit power or signals from a stationary object to a moving object. The rotary connector 10 has been developed to replace existing slip-ring type connectors currently used in many aircraft and vehicle applications. The spring loaded rotary connector 10 is very rugged and performs well in harsh outdoor environments. Two connectors 10 have been built and tested on an auto axle, and have performed well. The present invention may be used in cars, trucks, motor homes, motorcycles, and aircraft, wherever rotary electrical connectors may be employed.

Thus, an improved spring-loaded rotary connector has been described. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A rotary connector comprising:

a first member comprising a flexible printed circuit having one surface thereof that has a plurality of electrically isolated metallic rings formed thereon and having an opening therein for receiving a shaft, and further comprising a first rigid plate contacting an opposing external surface of said first member;

a first plurality of electrical wires individually attached to one of the plurality of electrically isolated metallic rings;

a second stationary member disposed adjacent to the first member and having an opening therein for receiving the shaft and having disposed therein a plurality of spring-loaded contacts disposed to engage the plurality of electrically isolated metallic rings of the first member wherein the first member is rotatable relative to the second member about the shaft; and a second plurality of electrical wires individually attached to respective spring-loaded contacts;

and wherein said rotary connector permits rotary motion between the first and second members about the shaft, allows relative angular movement between the first and second members, and compensates for relative separational distance therebetween.

2. The rotary connector of claim 1 wherein the first member comprises a copper laminated phenolic ring and each metallic ring has a hole disposed therethrough.

3. The rotary connector of claim 2 wherein the holes are plated.

4. The rotary connector of claim 1 wherein the first and second plurality of wires are routed to first and second connectors respectively.

5. The rotary connector of claim 1 wherein the second member comprises a phenolic member.

6. The rotary connector of claim 1 wherein said second member comprises a flexible printed circuit and further comprising a second rigid plate contacting the external surface of said second member.

7. The rotary connector of claim 2 wherein each hole has plating therein to provide a plated hole and said first plurality of electrical wires is attached to said metallic rings through said plated holes.

* * * * *